US006688955B2

(12) United States Patent
Ruey-Zon

(10) Patent No.: US 6,688,955 B2
(45) Date of Patent: Feb. 10, 2004

(54) GRINDING WHEEL FENDER ADJUSTING DEVICE AND GRINDING MEMBER SECURING DEVICE

(75) Inventor: Chen Ruey-Zon, TaLi (TW)

(73) Assignee: Motomax Electric Co., Ltd., Taichung Hsien (TW)

( * ) Notice: Subject to any disclaimer, the term of this patent is extended or adjusted under 35 U.S.C. 154(b) by 0 days.

(21) Appl. No.: 10/147,819

(22) Filed: May 20, 2002

(65) Prior Publication Data

US 2003/0216116 A1 Nov. 20, 2003

(51) Int. Cl.[7] ..... B24B 23/00; B24B 55/05
(52) U.S. Cl. ..... 451/360; 451/451; 451/455
(58) Field of Search ..... 451/344, 358–360, 451/442, 451, 452, 454, 455, 512

(56) References Cited

U.S. PATENT DOCUMENTS 1,464,959 A * 8/1923 Tuthill ..... 451/348
5,775,981 A * 7/1998 Yang ..... 451/295
6,264,408 B1 * 7/2001 Lung et al. ..... 409/182
6,561,887 B2 * 5/2003 Lai et al. ..... 451/358

FOREIGN PATENT DOCUMENTS

DE 3636500 A1 * 4/1988 ..... B24B/55/05
DE 3638337 A1 * 5/1988 ..... B24B/55/05
DE 3940584 A1 * 6/1991 ..... B24B/55/05

* cited by examiner

*Primary Examiner*—Joseph J. Hail, III
*Assistant Examiner*—David B. Thomas
(74) *Attorney, Agent, or Firm*—Rosenberg, Klein & Lee

(57) ABSTRACT

A grinding tool includes a handle with a driving device for driving a grinding member connected to a shaft extending from the driving device. A cone-shaped recess is defined in a distal end of the shaft and a flexible cone-shaped piece is received in the cone-shaped recess of the shaft. The grinding member has a shank extending through the flexible cone-shaped piece and a retaining cap is mounted to the shank and threadedly mounted to the shaft. The grinding member can be replaced with a grinding wheel and a fender is rotatably mounted to the shaft. A quick release device is connected to two lugs on the C-shaped collar of the fender so that the fender can be conveniently loosened and rotated by operating the quick release device.

9 Claims, 7 Drawing Sheets

GRINDING WHEEL FENDER ADJUSTING DEVICE AND GRINDING MEMBER SECURING DEVICE

FIELD OF THE INVENTION

The present invention relates to a grinding tool that has a fender rotatably mounted to a shaft base of the tool and a quick-release device connected between two ends of the C-shaped collar of the fender.

BACKGROUND OF THE INVENTION

A conventional grinding tool generally includes a handle with a driving means which drives a grinding wheel connected to a shaft of the driving means. A semi-circular shaped fender as shown in FIG. 8 is mounted to the shaft base by a C-shaped collar 51 which includes two lugs 512, 512' on two distal ends of the C-shaped collar 51. A locking bolt 500 extends through the lugs 512, 512' and is threadedly engaged with a nut 501. When using the grinding tool, metal debris flies in the direction that the grinding wheel rotates so that the fender 50 is used to prevent the metal debris from being attached to the cloth of the user. In other words, the user has to adjust the position of the fender 50 according to the way he/she use the grinding tool. The collar 51 can be loosened by unscrewing the locking bolt so that the fender 50 is able to be rotated an angle and then the locking bolt 500 is secured again to set the position the fender 50. However, it is not convenient for the user to take a wrench to loosen the locking bolt 500. Even if the locking bolt 500 can be rotated by hand, it still takes a lot of time.

SUMMARY OF THE INVENTION

In accordance with one aspect of the present invention, there is provided a grinding tool which comprises a shaft base extending from the driving device on an end of the handle and a shaft extends from the shaft base. A grinding wheel is secured on the shaft. A fender has a C-shaped collar mounted to the shaft base, a first lug and a second lug extending from two distal ends of the C-shaped collar. A U-shaped member is mounted on two sides of the first lug and the second lug. A lever has two cam plates and each of which has a hole eccentrically defined therethrough. The two cam plates are located between the two sides of the U-shaped member and a pin extends through the two sides of the U-shaped member and the two holes in the two cam plates. The two cam plates contact the second lug.

The primary object of the present invention is to provide an adjusting device which allows the user to loosen and secure the collar of the fender within a short period of time.

The other object of the present invention is to provide a securing device that secures the grinding members with different sizes of shanks.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
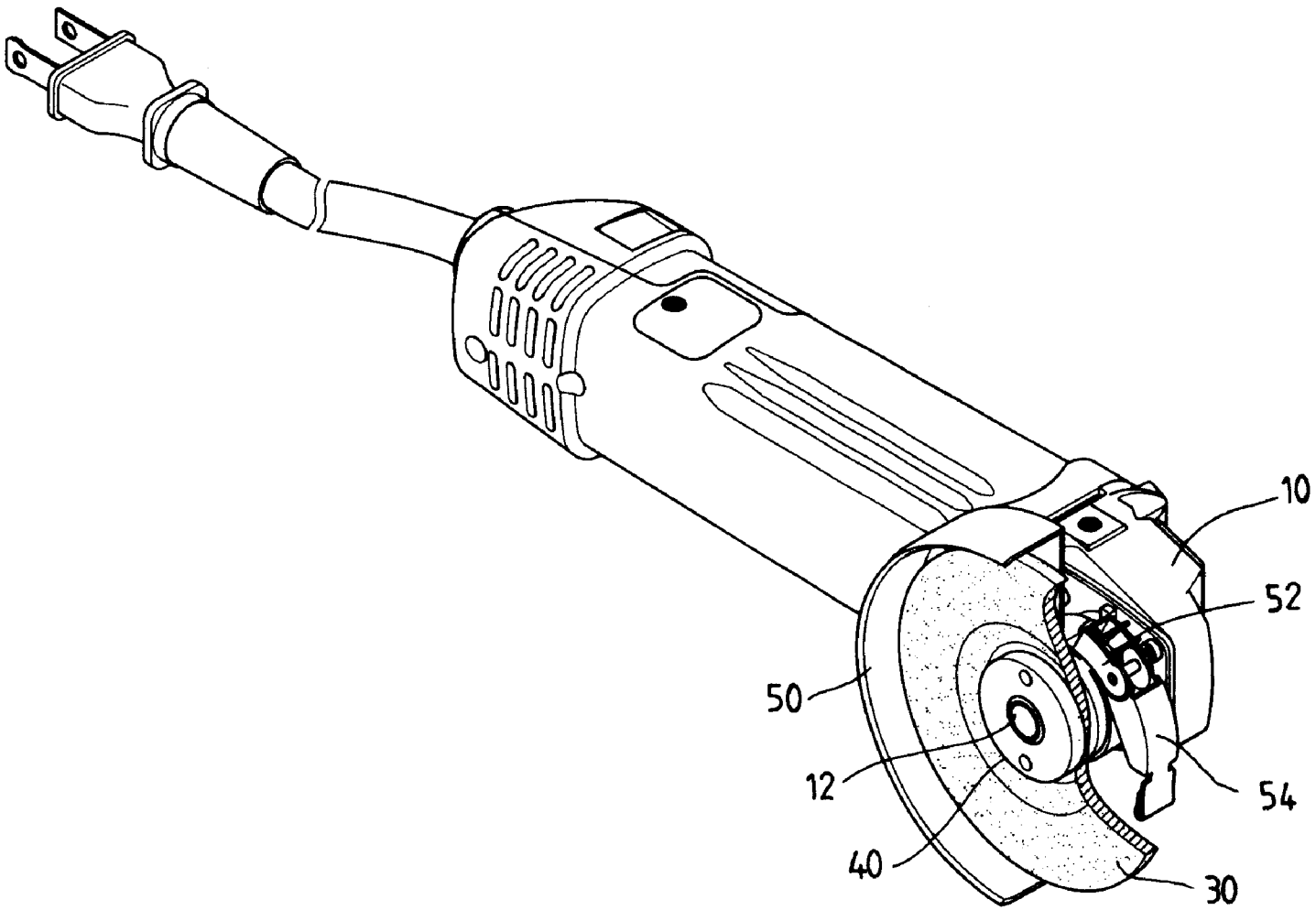
FIG. 1 is a perspective view to show the grinding tool of the present invention with a grinding wheel and a fender connected thereto.
Figure 2:
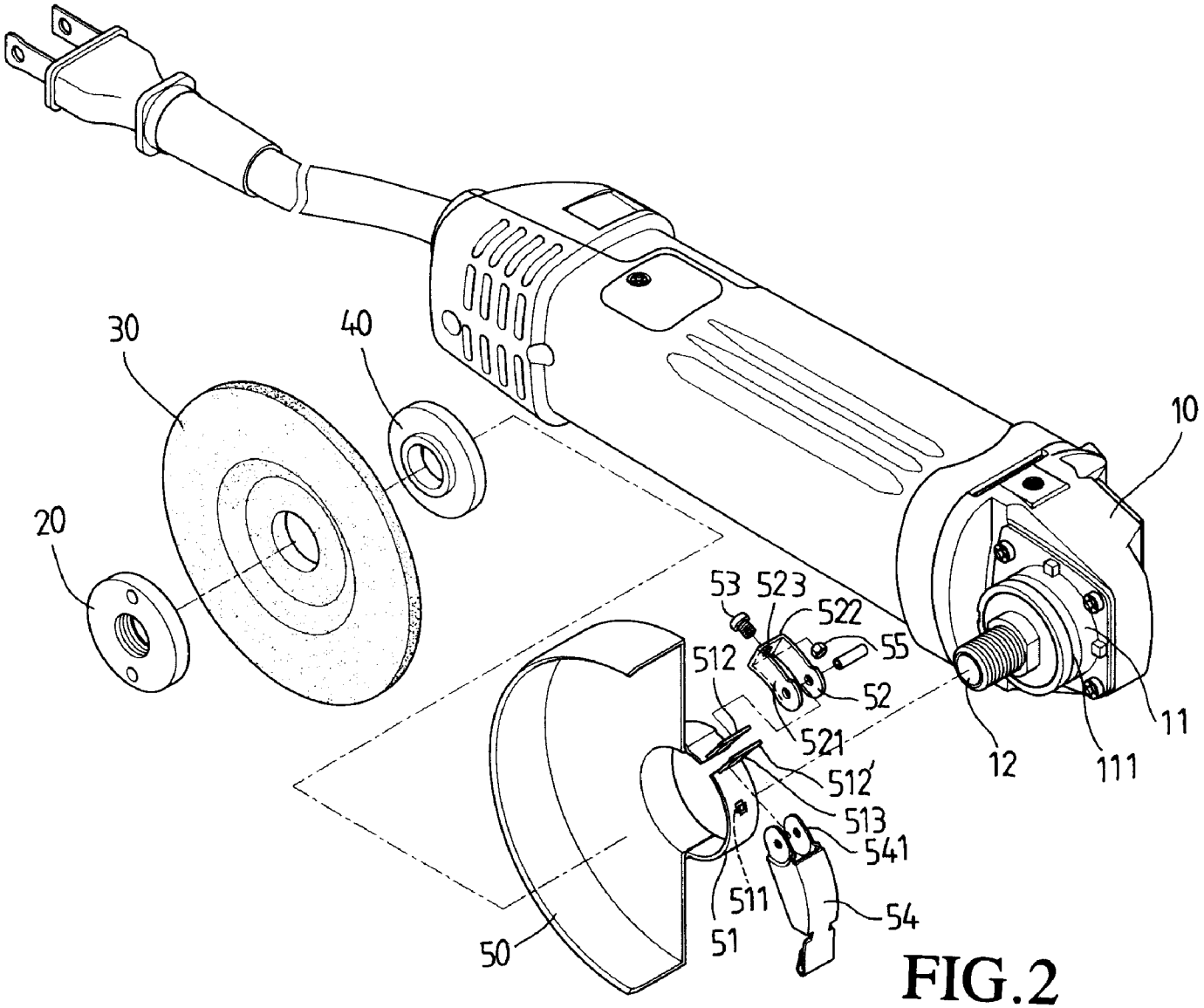
FIG. 2 is an exploded view to show the grinding tool of the present invention with a grinding wheel and a fender connected thereto.
Figure 3:
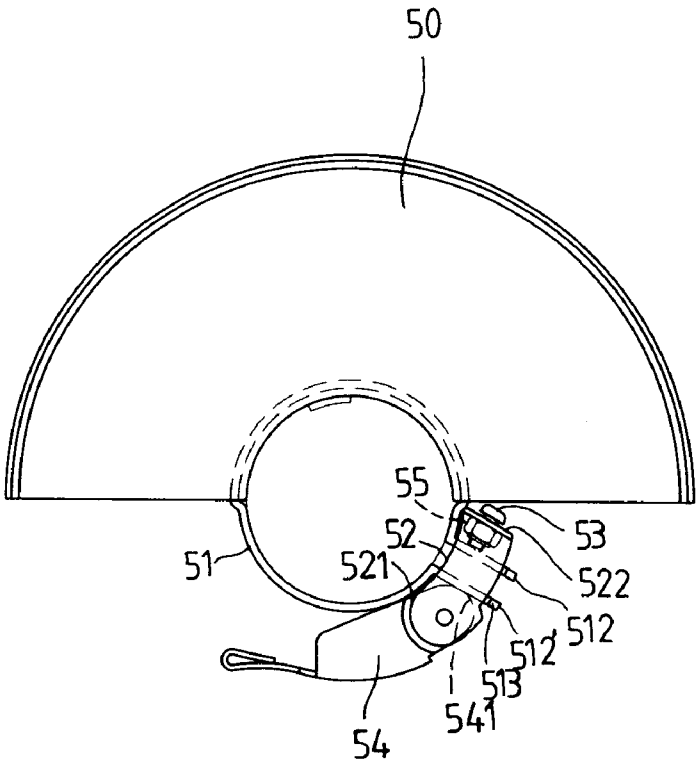
FIG. 3 is a plan view to show the collar of the fender is secured by the quick release device of the present invention.

Referring to FIGS. 1 to 3, the grinding tool of the present invention comprises a handle with a driving device 10 on a first end of the handle and an electric cable connected to a second end of the handle. A shaft base 11 extends from the driving device 10 and a shaft 12 extends from the shaft base 11. A grinding wheel 30 is secured on the shaft 12 by a lining ring 20 and a locking ring 40.

A fender 50 has a C-shaped collar 51 mounted to the shaft base 11 which has a groove 11 1 defined in an outer periphery thereof and the C-shaped collar 51 has a protrusion 511 extending from an inside thereof. The protrusion 511 is engaged with the groove 111 so as to prevent the fender 50 from being pulled out from the shaft base 11.

A first lug 512 and a second lug 512' extend from two distal ends of the C-shaped collar 51 respectively. Two notches 513 are defined in the two sides of each of the first lug 512 and the second lug 512'. A quick release device is connected to the first lug 512 and the second lug 512'. The quick release device includes a U-shaped member 52 whose two sides 521 are engaged with the notches 513, and a lever 54 which has two cam plates 541. Each of the two cam plates 541 has a hole eccentrically defined therethrough. The two cam plates 541 are located between the two sides 521 of the U-shaped member 52 and a pin extends through the two sides 521 of the U-shaped member 52 and the two holes in the two cam plates 541. The two cam plates 541 contact the second lug 512'. A bolt 53 extends through a cross plate 522 of the U-shaped member 52 and threadedly extends through a nut 55 located at the inside of the cross plate 522 and the distal end of the bolt 53 contacts the first lug 512.

Figure 4:
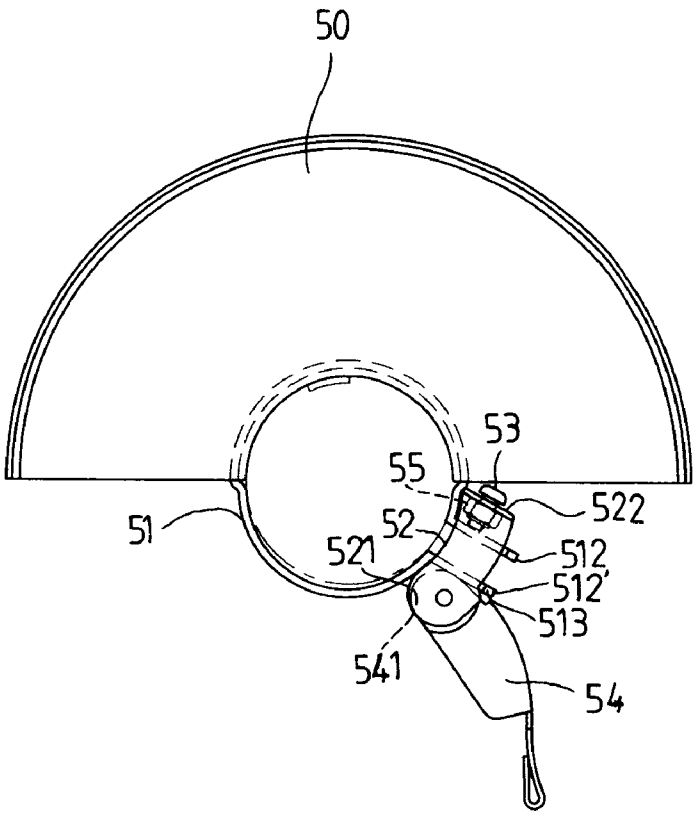
FIG. 4 is a plan view to show the collar of the fender is loosened by operating the quick release device of the present invention.
Figure 5:
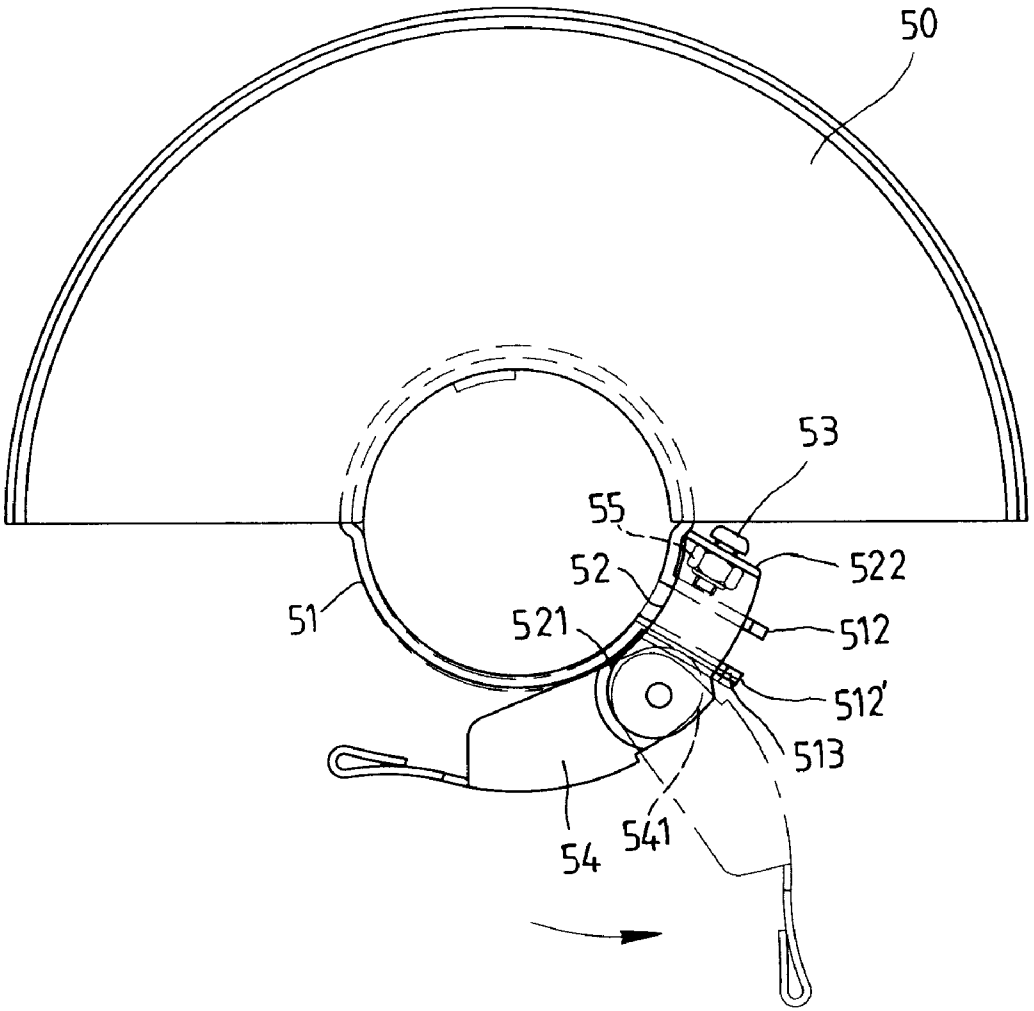
FIG. 5 is a plan view to show the two positions of the lever of the quick release device of the present invention.

Further referring to FIGS. 4 and 5, when the lever 54 is positioned at the position as shown in FIG. 3, the two sides 521 are pulled by the cam plates 541 so as to pull the two lugs 512, 512' close to each other to secure the collar 51 on the shaft base 11. When the lever 54 is pivoted to a position as shown in FIG. 4, the two sides 521 are loosened and the fender 50 can be conveniently rotated to a desired position, the collar 51 is able to be secured by pivoting the lever 54 to the position shown in FIG. 3.

Figure 6:
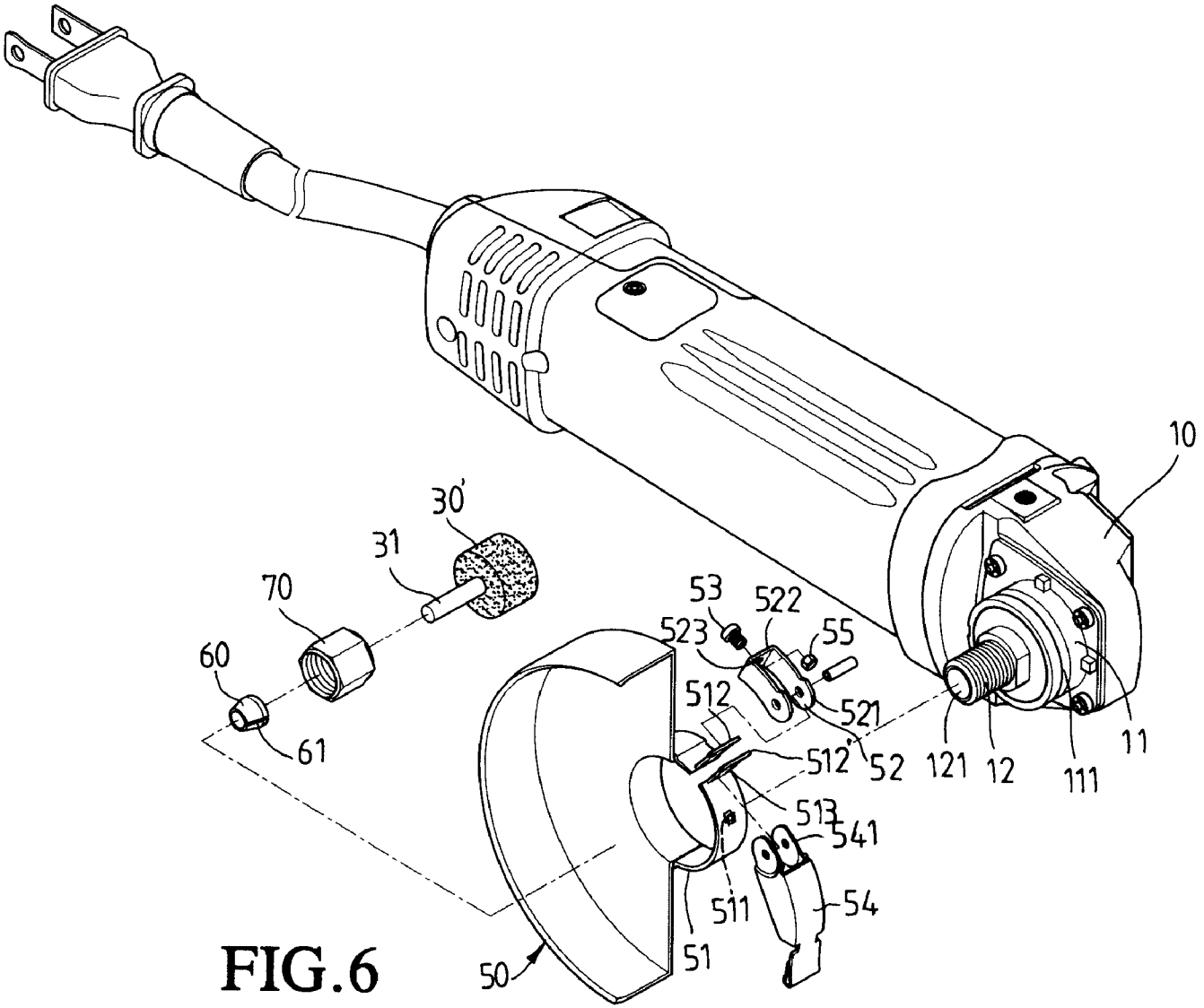
FIG. 6 is an exploded view to show a grinding member is replaced with the grinding wheel.
Figure 7:
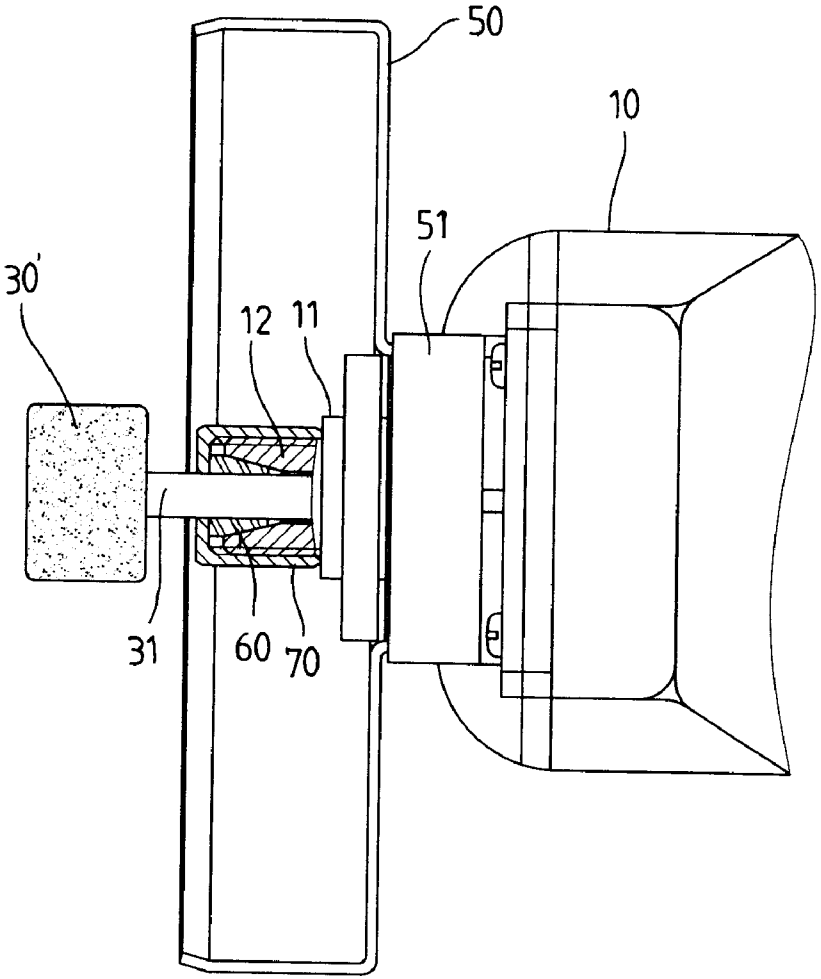
FIG. 7 shows a cross sectional view of the engagement of the grinding member inserted in the shaft.
Figure 8:
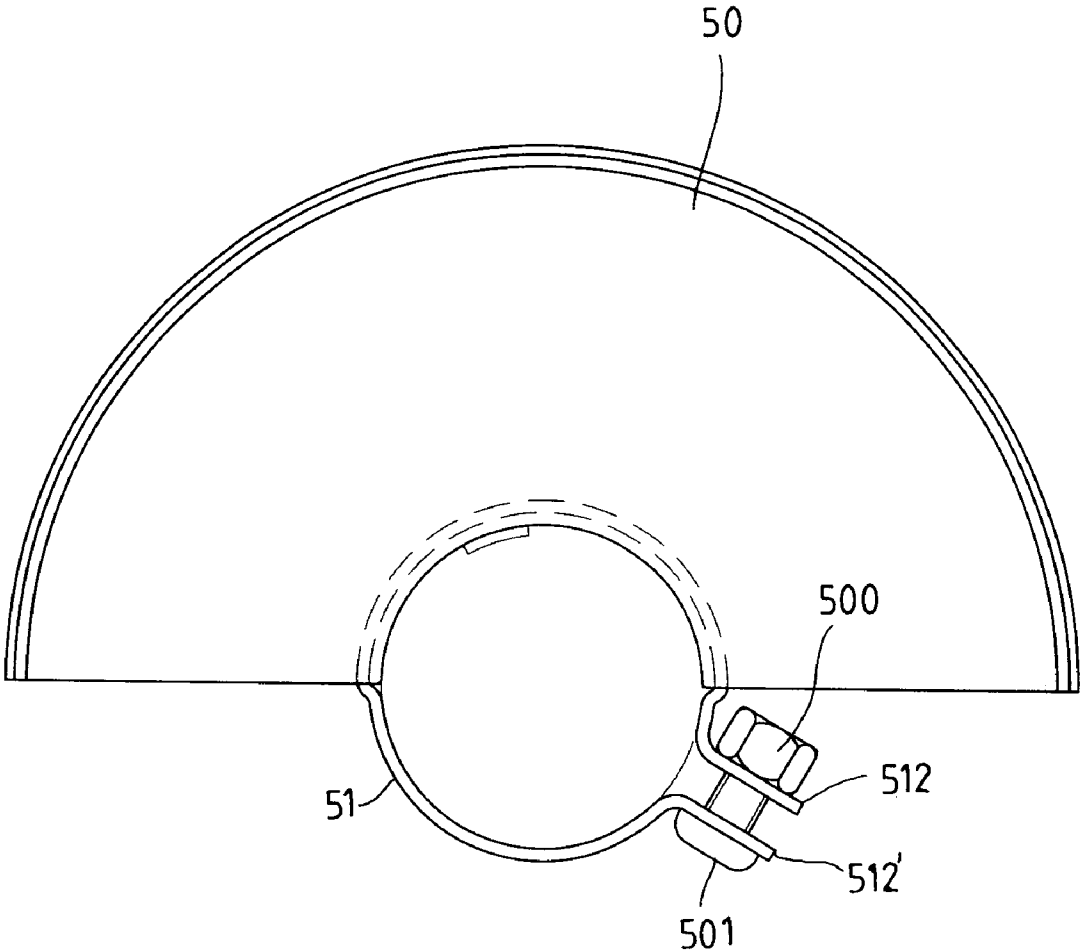
FIG.8 PRIOR ART
FIG. 8 shows a conventional way to secure the fender.

As shown in FIG. 6 and 7, the grinding wheel 30 can be replaced with a grinding member 30' which has a shank 31. The shaft 12 has a cone-shaped recess 121 defined in a distal end thereof and a flexible cone-shaped piece 60 is received in the cone-shaped recess 121 of the shaft 12. The flexible cone-shaped piece 60 has a slit 61 defined longitudinally through a wall of the flexible cone-shaped piece 60 so that the flexible cone-shaped piece 60 can be easily narrowed to be fitted in the cone-shaped recess 121.

The shank 31 extends through the flexible cone-shaped piece 60 and a retaining cap 70 is mounted to the shank 31 and threadedly mounted to the shaft 12 to position the grinding member 30'. The flexible cone-shaped piece 60 allows the grinding member 30' having different sizes to be quickly positioned in the shaft 12.

While we have shown and described the embodiment in accordance with the present invention, it should be clear to those skilled in the art that further embodiments may be made without departing from the scope of the present invention.

What is claimed is:

1. A grinding tool comprising:

a handle with a driving device on a first end of the handle and an electric cable connected to a second end of the handle, a shaft base extending from the driving device and a shaft extending from the shaft base, a grinding wheel secured on the shaft;

a fender having a C-shaped collar mounted to the shaft base, a first lug and a second lug extending from two distal ends of the C-shaped collar, and a U-shaped member mounted on two sides of the first lug and the second lug, a lever having two cam plates and each of which has a hole eccentrically defined therethrough, the two cam plates being located between two sides of the U-shaped member and a pin extending through the two sides of the U-shaped member and the two holes in the two cam plates, the two cam plates contacting the second lug.

2. The grinding tool as claimed in claim 1, wherein the shaft base has a groove defined in an outer periphery thereof and the C-shaped collar has a protrusion extending from an inside thereof, the protrusion engaged with the groove.

3. The grinding tool as claimed in claim 1, wherein a bolt extends through a cross plate of the U-shaped member and contacts the first lug.

4. The grinding tool as claimed in claim 1 wherein two notches are defined in the two sides of each of the first lug and the second lug so that the two sides of the U-shaped member are engaged with the notches.

5. A grinding tool comprising:

a handle with a driving device on a first end of the handle and an electric cable connected to a second end of the handle, a shaft base extending from the driving device and a shaft extending from the shaft base, a cone-shaped recess defined in a distal end of the shaft;

a flexible cone-shaped piece received in the cone-shaped recess of the shaft;

a grinding member having a shank connected thereto and the shank extending through the flexible cone-shaped piece;

a retaining cap mounted to the shank and threadedly mounted to the shaft; and a fender having a C-shaped collar mounted to the shaft base, a first lug and a second lug extending from two distal ends of the C-shaped collar, a U-shaped member mounted on two sides of the first lug and the second lug, a lever having two cam plates and each of which has a hole eccentrically defined therethrough, the two cam plates located between two sides of the U-shaped member and a pin extending through the two sides of the U-shaped member and the two holes in the two cam plates, the two cam plates contacting the second lug.

6. The grinding tool as claimed in claim 5 further comprising a slit defined longitudinally through a wall of the flexible cone-shaped piece.

7. The grinding tool as claimed in claim 5, wherein the shaft base has a groove defined in an outer periphery thereof and the C-shaped collar has a protrusion extending from an inside thereof, the protrusion engaged with the groove.

8. The grinding tool as claimed in claim 5, wherein a bolt extends through a cross plate of the U-shaped member and contacts the first lug.

9. The grinding tool as claimed in claim 5 wherein two notches are defined in the two sides of each of the first lug and the second lug so that the two sides of the U-shaped member are engaged with the notches.

* * * * *